United States Patent [19]

Boulanger

[11] Patent Number: 4,638,721

[45] Date of Patent: Jan. 27, 1987

[54] PRESSURE RESPONSIVE DEVICE

[75] Inventor: Henry J. Boulanger, Cumberland, R.I.

[73] Assignee: Texas Instruments Incorporated, Dallas, Tex.

[21] Appl. No.: 171,682

[22] Filed: Jul. 24, 1980

[51] Int. Cl.[4] ..... H01H 35/34

[52] U.S. Cl. ..... 92/6 D; 92/7; 92/98 R; 92/101

[58] Field of Search ..... 92/6 D, 7, 96, 98 R, 92/99, 101, 103 M; 200/83 R

[56] References Cited

U.S. PATENT DOCUMENTS

| | | | |
|---|---|---|---|
| 3,072,150 | 1/1963 | Hastings et al. | 92/98 R |
| 3,302,269 | 2/1967 | Cooper et al. | 200/83 R |
| 3,400,908 | 9/1968 | Bauer | 92/99 |
| 3,720,090 | 3/1973 | Halpert et al. | 73/4 R |
| 4,220,836 | 9/1980 | Hersey | 92/103 M |

*Primary Examiner*—Robert E. Garrett

*Attorney, Agent, or Firm*—James P. McAndrews; John A. Haug; Melvin Sharp

[57] ABSTRACT

A pressure responsive device suitable for high pressure hydraulic applications has a formed metal disc or diaphragm adapted to move from an original dished configuration toward an inverted dished configuration with snap action in response to the application of a selected fluid pressure. Support means of selected surface radius extend into the space defined by the original dished configuration of the diaphragm to intercept and limit such diaphragm movement to prevent damage to the diaphragm under the applied pressure and to limit stresses in the diaphragm material particularly adjacent to the periphery of the dished part of the diaphragm for improving reliability and service life of the device.

7 Claims, 5 Drawing Figures

PRESSURE RESPONSIVE DEVICE

BACKGROUND OF THE INVENTION

This invention relates to pressure responsive devices for use in automobiles, tractors and other heavy equipment and the like for performing a control function in response to the occurence of selected pressure levels in the equipment during equipment operation. The invention relates more particularly to pressure responsive devices which are subjected to relatively high hudraulic pressures in automobile applications and the like and which are adapted to be reliable and to display long service lives in such applications.

Conventional pressure responsive devices have control components such as electrical contact means which are movable to perform control functions when selected levels of pressure are applied to the devices. Many of such devices incorporate a metal disc or diaphragm having a flange for use in mounting the diaphragm and having a domed central portion which is movable from an original dished configuration toward an inverted dished configuration when a selected fluid pressure is applied to the diaphragm. The snap acting movement of the domed disc portion causes sharp movement of the electrical contacts or other control components between the noted control positions, and the characteristics of the disc determine the actuating pressure at which such movement occurs. The disc diaphragm also serves to seal the device against fluid pressures in the zone being monitored. In many conventional devices which are intended for use in high pressure zones, a support engages the disc when the disc has moved into its inverted dished configuration for preventing excessive movement of the disc to avoid disc rupture. However, it is frequently found that, when such devices are subjected to relatively high levels of applied pressure, the devices tend to have relatively short service lives even though the device proportions have been increased to display greater strength. In this regard, it has been found that the disc diaphragms have tended to be subject to fatigue cracking in high pressure applications, particularly at the locations where the domed disc portions join the flange parts of the discs.

It is an object of this invention to provide a novel and improved pressure device and to provide such a device which is adapted to display improved reliability and service life even when used in high pressure applications.

BRIEF SUMMARY OF THE INVENTION

Briefly described, the novel and improved pressure responsive device of this invention includes control components such as electrical contacts which are movable between control positions for performing a control function. The device also includes a metal disc or diaphragm having a flange part welded to a housing for mounting the diaphragm and having a domed central portion which is movable from an original dished configuration to an inverted dished configuration with snap action in response to the application of a selected level of fluid pressure to the diaphragm. The diaphragm is arranged to be exposed to fluid pressures in a zone to be monitored and is arranged so that initial movement of the disc in response to the occurence of the selected actuating pressure in the zone is effective to move the contacts or other control components sharply between the desired control positions.

In accordance with this invention, the device further includes a support which is mounted on the housing to extend part way up into the space defined by the original dished configuration of the diaphragm. The support is positioned to intercept the moving disc diaphragm after it has effected the desired movement of the control components and before it is subjected to any excessive and potentially damaging stresses. In this regard, it is found that initial snap acting movement of the disc diaphragm from its original dished configuration tends to flatten or increase the radius of the dished disc surface inside the domed part of the disc adjacent to the periphery of the domed disc part. At the same time, the center of the domed part of the disc begins to invert its curvature. The inner radius of the domed part of the disc adjacent the periphery of the disc then continues to increase or flatten its radius as the inversion of the central part of the dome progresses and deepens. There is also a progressive decrease in the inner radius in the inverted part of the disc as the inversion of that disc part progresses. As a result of the nature of this disc movement, there is substantial initial movement of the central part of the disc dome sufficient to assure proper movement of the electrical contacts or other control components between control positions before the peripheral part of the domed disc begins to invert its curvature. In the device of this invention, the support is therefore extended into the space defined by the original dished configuration of the disc to intercept and engage the inner disc surface before it inverts adjacent the peripheral part of the disc, thereby to limit further disc movement. Preferably the surface of the support which extends up to engage that peripheral part of the dome is provided with a surface radius conforming to the radius that the disc surface has when it comes into engagement with the support. Preferably also, other portions of the support surface are provided with curvatures which are also selected to correspond to curvatures of the other parts of the domed disc as the domed disc engages the support. Typically for example, the support has a central opening which accommodates a motion transfer member extending from the disc diaphragm to the contacts or other control components which are to be moved in response disc movement. In the device of this invention, the support is provided with a concave surface of selected radius around that opening to correspond to the outer surface of the inverting central part of the domed disc as that inverting part of the dome comes into contact with the support. In that way, the support prevents rupture of the disc diaphragm even under very high applied fluid pressures. It also prevents the application of excessive or damaging stresses to the disc diaphragm such as might cause fatigue cracking in the disc or might cause undesired drift or variation in the actuating pressure intended to be provided by the original disc characteristics.

DESCRIPTION OF THE DRAWINGS

Other objects, advantages and details of the pressure responsive device of this invention appear in the following detailed description of preferred embodiments of the invention, the detailed description referring to the drawings in which.

DESCRIPTION OF THE PREFERRED EMBODIMENTS

Figure 1:
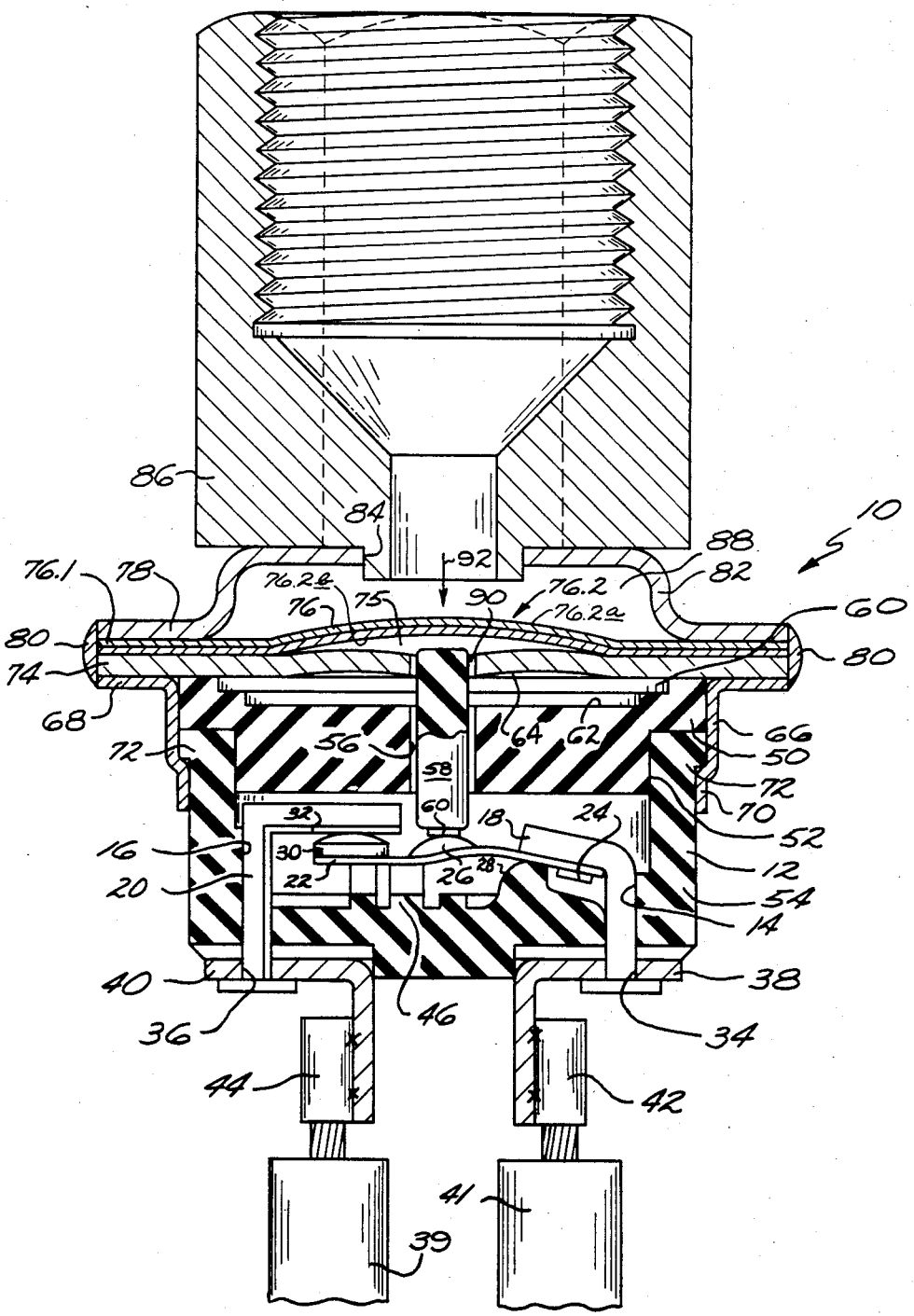
FIG. 1 is a section view along the longitudinal axis of the pressure responsive device of this invention.

Referring to the drawings, switch 10 comprises a cylindrical cup-shaped housing member 12 formed of a conventional molded electrically insulating phenolic material. The housing is formed with apertures 14 and 16 for reception of support member 18 and stationary contact 20 respectively. Movable contact arm 22 of an electrically conductive material having good spring characteristics such as beryllium copper is cantilever mounted to support member 18 as by riveting at 24. Arm 22 is formed with a dimple 26 and mounts a movable contact 30 on the free end of the arm. A boss 28 is formed in the bottom wall of base 12 so that when support member 18 and movable contact arm 22 are inserted through aperture 14, they are biased against the boss to effect a given angle such that a predetermined contact force will exist between contacts 20 and 30. To improve electrical conductivity while minimizing expense, the stationary contact 20 also serves as part of the terminal structure and is preferably provided with a limited layer 32 of highly conductive material, such as a silver alloy. The outer ends of support 18 and stationary contact 20 pass through apertures 34 and 36 in the terminal members 38 and 40 respectively, and are headed over to firmly lock the contact assembly in the housing and to provide electrical connection to the switch via leads 39 and 41. The leads are clinched in tabs 42 and 44 respectively which are in turn welded to terminal members 38 and 40. To mitigate the deleterious effects of arcing, ribs 46 are formed in the base member 12 to prevent tracking of vaporized contact material by providing an arc shadow, a common expedient employed in the art.

A generally plate-shaped disc 50 of electrically insulating phenolic material or the like if formed with a seating groove 52 about its periphery and is received in the distal portion of the wall 54 of base 12. Disc 50 has a centrally located bore 56 provided with a motion transfer pin 58 of electrically insulating material such as ceramic or glass. Pin 58 may be formed with projection 60 on one end which contacts dimple 26 on the movable arm 22 to enhance smooth transfer of motion from the pin 58 to the arm. A cavity 64 is formed by recessing disc 50 at 60 and 62 as shown in FIG. 1.

A tubular member 66 which may be formed of any conventional metallic material is formed with a radially outwardly extending flange 68 and is placed over the distal wall 54 of the base 12 and attached thereto as by crimping at 70. It will be noted that a small flange 72 is provided on the distal wall 54 to facilitate locking of the tubular member 66 to the base 12. Mounted on flange 68 are a support member 74, imperforate circular diaphragm member 76, and cover 78, all hermetically secured at their peripheries as by welding at 80. Cover 78 is dished out at 82 to provide a cavity 88 sealed by the diaphragm 76 and is provided with a bore 84 for reception therein of a port fitting 86 which is hermetically attached thereto. The port fitting 86 permits attachment of the device 10 to a pressure zone to be monitored as will be understood.

Although it is preferred that the cover 78, diaphragm 76, support member 74 and the tubular member 66 be welded together at their marginal periphery, it will be understood that other means may be employed to clamp and seal the diaphragm member between the other members.

Diaphragm 76 preferably comprises two separate, formed and nested metal discs each having a flange part 76.1 and a domed central part 76.2. Typically the diaphragm discs are formed of stainless steel or other stiffly resilient spring material so that the central domed part 76.2 of the diaphragm has an original configuration as shown in FIG. 1 having an originally convex side **76.2*a* and an originally concave side 76.2*b* and is adapted to move from its original dished configuration as shown in FIG. 1 toward an inverted dished configuration with snap action when a sufficient force is applied originally convex side 76.2*a* of to the diaphragm as indicated by the arrow 92 in FIG. 1. The diaphragm 76** is also formed of a single disc or of more than two discs if desired within the scope of this invention, the number of discs and the proportions being selected in conventional manner for determining the actuation pressure level at which the diaphragm is adapted to snap from its original dished configuration toward its inverted configuration as will be understood.

The support means 74 preferably has a central opening 90 through which the motion transfer pin 58 extends between the disc diaphragm 76 and the switch arm 22. In that arrangement, the fitting 86 is adapted to be mounted in the wall of a chamber enclosing a pressure zone to be monitored so that the diaphragm 76 is exposed to a fluid pressure as indicated in FIG. 1 by the arrow 92. When the fluid pressure in the zone reaches a level such that the fluid pressure applied to the diaphragm 76 results in sufficient force to initiate snap acting movement of the diaphragm, the diaphragm moves toward its inverted configuration to move the pin 58 to move the switch arm 22 to open circuit position. As thus far described, the pressure responsive device 10 is conventional and corresponds to that shown in U.S. Pat. No. 3,720,090 for example.

Figure 2:
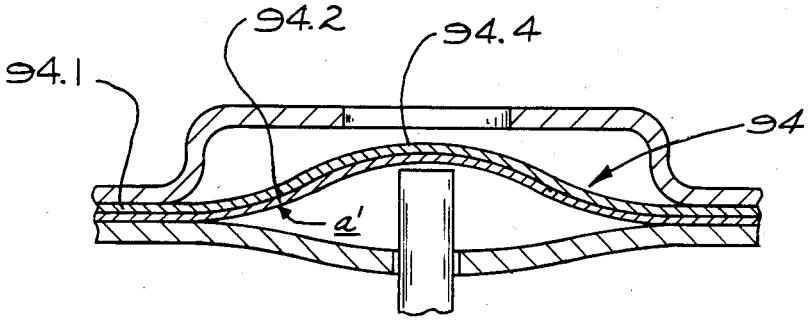
PRIOR ART Fig. 2.
FIGS. 2 and 3 are partial section views to enlarged scale similar to FIG. 1 illustrating operating charcteristics of pressure responsive devices known in the prior art.
Figure 3:
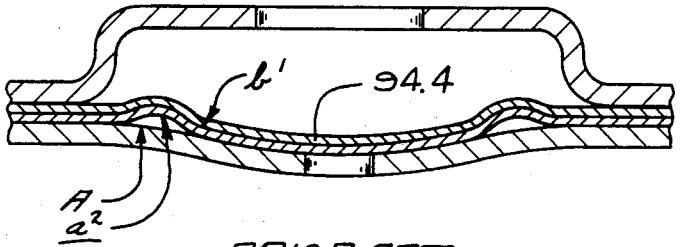
PRIOR ART Fig. 3.
Figure 4:
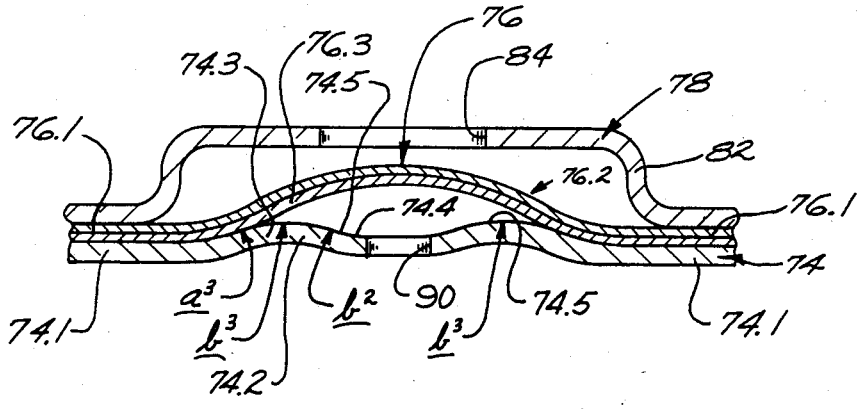
FIGS. 4 and 5 are partial section views to enlarged scale corresponding to FIGS. 2 and 3 illustrating operating characteristics of the pressure responsive device of FIG. 1.
Figure 5:
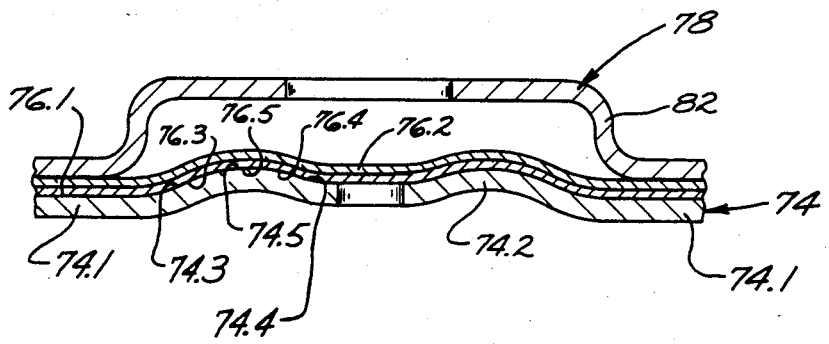

In accordance with the present invention however, the support means 74 is provided with a selected surface configuration and is arranged to extend part way up into the space 75 defined by the original dished configuration of the domed part 76.2 of the diaphragm 76. In this regard, it has been found that when a diaphragm disc means 94 initially moves with snap action from the original dished configuration in a conventional device as shown in FIG. 2 to the inverted dished configuration shown in FIG. 3, the inner radius $a^1$ of the domed disc part 94.2 tends to increase or to flatten adjacent to the periphery of the domed part of the disc where the domed disc part joins the disc flange part 94.1. That is, the radius $a^1$ shown in FIG. 2 increases or flattens to a larger radius $a^2$ as illustrated in FIG. 3. At the same time, the central portion 94.4 of the domed part 94.2 begins to invert its curvature. As this central inversion occurs, the radius $b^1$ within the inversion progressively decreases so that the inversion deepens and moves out toward the periphery of the domed disc part as will be understood. As that occurs, the diaphragm discs tend to be subjected to excessive stress at point A as indicated in FIG. 3, particularly where the diaphragm is subjected to relatively high fluid pressures of above 1,000 psi. or the like in hydraulic applications. That is, at a point in the disc movement, stresses in the disc tend to be concentrated at the point A where the disc had been permanently deformed in forming the domed part of the disc.

In the pressure responsive device 10 of this invention, the support 74 has a flange part 74.1 for use in mounting the support in the housing and also has a domed or raised part 74.2 which extends part of the way up into the space defined by the original dished configuration of the diaphragm 76 to intercept and limit such snap acting movement of the diaphragm 76. Preferably the outer periphery 74.3 of the raised part of the support is of a convex configuration provided with a radius $a^3$ which is adapted to substantially conform to the peripheral part 76.3 of the domed diaphragm 76 when that diaphragm has moved sufficiently to engage the support. Preferably also the support has a concave part 74.4 of selected radius and has other portions 74.5 which are also provided with selected curvatures $b^2$ and $b^3$ to conform to corresponding curvatures on the disc portion 76.4 and 76.5 as those disc portions engage the support. Of course if the similar devices utilize a motion transfer pin 58 which is arranged to engage the opposite side of the diaphragm 76 so that the opening 90 can be omited from the support 74, the radius $b^2$ can be extended to cover the entire central portion of the support.

In that way, the central part 76.4 of the diaphragm 76 is formed to permit the movement necessary for moving the contact arm 22 between its desired control positions. However, the support 74 avoids rupture of the diaphragm and also avoids any concentration of stresses in the diaphragm such as would cause fatigue cracking in the disc or such as would cause drift in the spring characteristics of the disc to result in undesired variation in the actuating pressure of the device. The limiting of the diaphragm movement by the support 74 extending up into the space 75 also tends to limit relative movement between discs which make up the diaphragm 76, thereby tending to avoid any galling occurring between the discs.

It should be understood that although preferred embodiments of the invention have been described above by way of illustrating the invention, the invention also includes any modifications and equivalents of the disclosed embodiments falling within the scope of the appended claims.

I claim:

1. A pressure responsive device comprising a preformed dished metal diaphragm having a domed central part and a flange part and having the domed central part of the diaphragm joined to the flange part at a location extending in a plane to mount the diaphragm, the domed central part of the diaphragm originally having a concave side and a convex side upstanding from said plane and being adapted to move from an original dished configuration toward an inverted dished configuration to tend to pass through said plane with snap action in response to application of a selected pressure to the originally convex side of the diaphragm to perform a control function, characterized in that support means engage and mount the flange part of the diaphragm at said plane and in that a portion of the support means extends up through that plane into the space defined by the originally concave side of the original dished configuration of the domed central part of the diaphragm adjacent at least a portion of the domed central part of the diaphragm extending around the periphery of the domed central part of the diaphragm, said portion of the support means being originally spaced from the concave side of the domed central part of the diaphragm but being disposed for intercepting and engaging said portion of the diaphragm extending around the periphery of the domed central part of the diaphragm on said originally concave side of the diaphragm within said space during such snap-acting movement to limit snap acting movement of said periphery of the domed central part of the diaphragm and to positively support and prevent movement of at least said peripheral portion of the domed central part of the diaphragm through said plane for avoiding the development of excessive stresses in that peripheral portion of the domed central part of the diaphragm.

2. A pressure responsive device comprising a preformed dished metal diaphragm having a flange part extending in a plane to mount the diaphragm and having a domed central part originally having a concave side and a convex side upstanding from the plane of the flange part for moving from an original dished configuration toward an inverted dished configuration with snap action in response to application of a selected pressure to the originally convex side of the diaphragm to perform a control function, characterized in that support means engage and mount the flange part of the diaphragm at said plane and extend up through that plane into the space defined by the originally concave side of the original dished configuration of the domed diaphragm part for intercepting and engaging the diaphragm on said originally concave side within said space during such snap-acting movement to limit such snap-acting diaphragm movement to that necessary for performance of such control function while avoiding the development of excessive stresses in the diaphragm, and in that the support means has a flanged part mounting the diaphragm flange part on the support means and has a domed part extending part way up through said plane into the space defined by the original fished configuration of the domed diaphragm part, the domed support means part having an outer peripheral portion provided with a convex configuration of a selected radius which extends up through said plane into said space to intercept and be engaged by and to conform to the radius of a moving outer peripheral portion of the originally concave side of the domed part of the diaphragm within said space during said snap-acting movement, and having a central portion provided with a concave configuration of a selected radius to be engaged by and to conform to the central portion of the domed part of the diaphragm during said movement.

3. A pressure responsive device comprising control components movable between control positions to perform a control function, a preformed diaphragm having a flange portion for mounting the diaphragm in the device and having a domed central part movable from an original dished configuration toward an inverted dished configuration with snap action in response to the application of a selected fluid pressure to the diaphragm to move the control components between said control positions, and support means for engaging the diaphragm to prevent rupture of the diaphragm when relatively higher pressures are applied to the diaphragm, characterized in that, the domed central part of the diaphragm is joined to the flange portion of the diaphragm along a line extending in a plane, the domed central part of the diaphragm originally has a convex side and a concave side and is adapted to move from the original dished configuration toward the inverted dished configuration and to tend to pass through said plane with snap-action in response to application of said pressure to the originally convex side of the diaphragm, and in that the support means is rigid and has a portion which extends up through that plane part of the way up into the space defined by the original concave side of the domed portion of the diaphragm adjacent at least a portion of the domed central part of the diaphragm extending around the periphery of the domed central part of the diaphragm, said portion of the support means being originally disposed in spaced relation to the originally concave side of the diaphragm within that space and being adapted to intercept and engage and positively support said portion of the originally concave side of the diaphragm along said periphery of the domed diaphragm part within said space along said line during such snap-acting movement of the diaphragm to limit movement of at least said periphery of the domed central part of the diaphragm while permitting such diaphragm movement as is necessary for moving the control components between said control positions, thereby to avoid the development of excessive stresses in said peripheral part of said domed part of the diaphragm.

4. A pressure responsive device comprising control components movable between control positions to perform a control function, a preformed diaphragm having a flange portion for mounting the diaphragm in the device and having a domed central part movable from an original dished configuration toward an inverted dished configuration with snap action in response to the application of a selected fluid pressure to the diaphragm to move the control components between said control positions, and support means for engaging the diaphragm to prevent rupture of the diaphragm when relatively higher pressures are applied to the diaphragm, characterized in that, the support means extends part of the way up into the space defined by the original dished configuration of the domed portion of the diaphragm to intercept and engage the diaphragm to limit such diaphragm movement to that which is necessary for moving the control components between said control positions while avoiding the development of excessive stresses in the diaphragm, and in that the support means has a flange part mounting the diaphragm in the device and has a domed central part extending part way into the space defined by the original dished configuration of the diaphragm, the domed support part having an outer peripheral portion provided with a convex configuration of a selected radius to conform to the radius of the peripheral portion of the domed part of the diaphragm engaged by the support and having a central portion provided with a concave configuration of a selected radius to conform to the central part of the domed part of the diaphragm.

5. A pressure responsive device as set forth in claim 4 wherein the diaphragm and support means have the domed parts thereof nested together and have the flanged parts thereof welded together.

6. A condition responsive device comprising a preformed dished metal diaphragm having a rim part extending in a plane to mount the diaphragm and having a domed central part originally having a concave side and a convex side upstanding from the plane of the rim part for moving from an original dished configuration toward an inverted dished configuration with snap action in response to the occurrence of a selected condition to perform a control function, characterized in that rigid support means engage and mount the rim part of the diaphragm at said plane and a portion of the support means extends up through the plane into the space defined by the originally concave side of the original dished configuration of the diaphragm adjacent at least a portion of the domed central part of the diaphragm extending around the periphery of the domed central part of the diaphragm, said portion of the support means being spaced from the originally concave side of the domed central part of the diaphragm around said peripheral portion of the domed central part of the diaphragm and being positioned for intercepting and engaging at least said peripheral portion of the domed central part of the diaphragm on said originally concave side within said space during such snap-acting movement, said portion of the support means having a selected radius to conform to and support said peripheral portion of the domed central part of the diaphragm to limit movement of at least said peripheral portion of the domed central part of the diaphragm while permitting such diaphragm movement as is necessary for performance of such control function, thereby to avoid the development of excessive stresses in said peripheral portion of the domed central part of the diaphragm.

7. A condition responsive device comprising a preformed dished metal diaphragm having a rim part extending in a plane to mount the diaphragm and having a domed central part originally having a concave side and a convex side upstanding from the plane of the rim part for moving from an original dished configuration toward an inverted dished configuration with snap action in response to the occurrence of a selected condition to perform a control function, charcterized in that support means engage and mount the rim part of the diaphragm at said plane and extend up through that plane into the space defined by the originally concave side of the original dished configuration of the diaphragm for intercepting and engaging the diaphragm on said originally concave side within said space during such snap-acting movement to limit such snap-acting diaphragm movement to that necessary for performance of such control function while avoiding the development of excessive stresses in the diaphragm, and in that the support means has a part mounting the rim part of the diaphragm on the support means and has a domed part extending through said plane part way up into the space defined by the originally concave side of the original dished configuration of the diaphragm, the domed support means part having an outer peripheral portion provided with a convex configuration of a selected radius which extends up through said plane into said space to be engaged by and to conform to the radius of the outer peripheral portion of the originally concave side of the domed part of the diaphragm within said space during said movement, and having a central portion provided with a concave configuration of a selected radius to be engaged by and to conform to the central portion of the domes part of the diaphragm during said movement.

* * * * *